US005382136A

United States Patent [19]

Wang

[11] Patent Number: 5,382,136

[45] Date of Patent: Jan. 17, 1995

[54] EXPANDABLE WINDOW FAN

[75] Inventor: Jui-Shang Wang, Taipei, Taiwan, Prov. of China

[73] Assignee: Duracraft Corporation, Whitinsville, Mass.

[21] Appl. No.: 59,075

[22] Filed: May 10, 1993

[51] Int. Cl.[6] ..... F03D 11/04

[52] U.S. Cl. ..... 416/247 R; 454/210

[58] Field of Search ..... 416/247 R; 454/208, 454/210; 74/159

[56] References Cited

U.S. PATENT DOCUMENTS

| | | | |
|---|---|---|---|
| 2,228,224 | 1/1941 | Benson | 454/210 |
| 2,436,344 | 2/1948 | Winogrond | 454/210 |
| 2,487,294 | 11/1949 | Belter | 454/210 |
| 2,846,936 | 10/1958 | Copeland | 454/210 |
| 4,838,151 | 6/1989 | Shin-Chin . | |
| 4,872,399 | 10/1989 | Chaney | 454/210 |
| 5,190,496 | 3/1993 | Shih-Chin . | |

*Primary Examiner*—Edward K. Look
*Assistant Examiner*—Mark Sgantzos
*Attorney, Agent, or Firm*—John E. Toupal; Harold G. Jarcho

[57] ABSTRACT

A window fan having a housing with a bottom wall for mounting on a sill of a window opening, a front wall defining an air outlet, a rear wall defining an air inlet, a first side wall joined to the front wall and the rear wall, a second side wall joined to the front wall and the rear wall; and the first side wall defining an elongated opening extending between opposite ends thereof; a blower retained by the housing and activatable to produce air flow between the air inlet and the air outlet; a partition biased into a recessed position within the housing and movable through the elongated opening into a projecting position extending between the first end wall and one side of the window opening; and a latch for retaining the wall in its projecting position.

13 Claims, 5 Drawing Sheets

EXPANDABLE WINDOW FAN

BACKGROUND OF THE INVENTION

This invention relates generally to portable electric fans and, more particularly, to an adjustable window fan.

Electric fans are used extensively to improve personal comfort levels during periods of high temperature. Often air circulation is desired between an inhabited enclosure and the surrounding environment. In those cases, portable fans frequently are mounted in a window opening and used to circulate air in either an exhaust or intake mode. Maximum operating efficiency is obtained by sealing the perimeter of the fan's housing in the window opening. Consequently, the housings of certain portable fans have been provided with adjustable wings that can be moved into engagement with the side edges of a window opening. Although improving air circulation efficiency, the extendable wings of prior portable fans have utilized relatively cumbersome adjustment mechanisms.

The object of this invention, therefore, is to provide a portable fan with improved, low cost and easily adjusted transversely extending partitions.

SUMMARY OF THE INVENTION

The invention is a window fan having a housing with a bottom wall for mounting on a sill of a window opening, a front wall defining an air inlet, a rear wall defining an air outlet, a first side wall joined to the front wall and the rear wall, a second side wall joined to the front wall and the rear wall; and the first side wall defining an elongated opening extending between opposite ends thereof; a blower retained by the housing and activatable to produce air flow between the air inlet and the air outlet; a partition biased into a recessed position within the housing and movable through the elongated opening into a projecting position extending between the first end wall and one side of the window opening; and a latch for retaining the wall in its projecting position. The inwardly biased wall permits the use of a simple, low cost, and easily operated latch.

According to one feature of the invention, the partition includes a convoluted panel contractible into the recessed position within the housing and expandable into the projecting position. Provision of the desired inward bias is facilitated by the convoluted panel.

According to another feature of the invention, the convoluted panel is formed in a contracted condition from a resilient material that tends to return to its contracted condition after being expanded into an expanded condition. The convoluted panel inherently biases the wall into its recessed position.

According to yet another feature of the invention, the partition has an inner edge fixed within the housing and a free outer edge accessible through the elongated opening with the partition in its recessed position. The accessible edge facilitates manual adjustment of the wall into its projecting position.

According to still another feature of the invention, the latch includes at least one ratchet bar movable with the partition, and at least one pawl fixed to the housing and engaged with the ratchet bar. This feature provides a simple, easily operated latch mechanism.

According to further features of the invention, the partition has an upper edge and a lower edge, the one ratchet bar is substantially aligned with the upper edge, and the latch includes another ratchet bar substantially aligned with the lower edge and another pawl fixed to the housing and engaged with the another ratchet bar. More secure latching is provided by the provision of the second ratchet and pawl assembly.

According to additional features of the invention, the one ratchet bar has a free inner end and an outer end fixed to one end of the outer edge, the another ratchet bar has a free inner end and an outer end fixed to an opposite end of the outer edge, and the housing defines a first channel slidably retaining the one ratchet bar and a second channel slidably retaining the another ratchet bar. A simple, effective latching mechanism is provided by these structural features.

According to further features of the invention, the second side wall defines another opening extending between opposite ends thereof, and the fan includes a second partition biased into a recessed position within said housing and movable through the another opening into a projecting position extending between the second end wall and an opposite side of the window opening. The provision of a second partition facilitates sealing of the fan within a window opening.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 3:
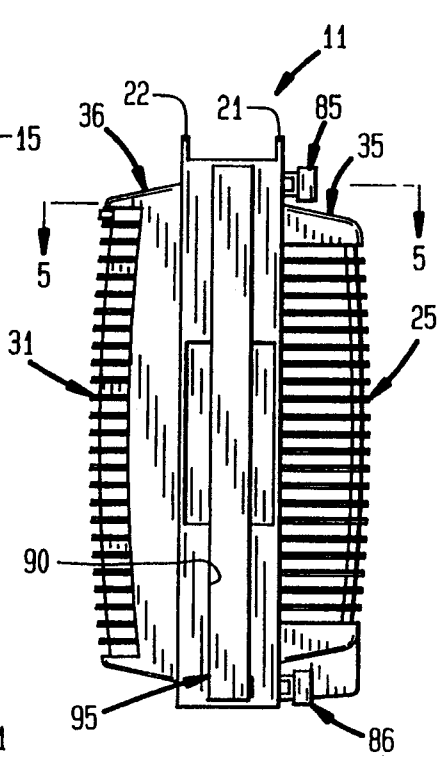
FIG. 3 is a side elevational view of the fan shown in FIGS. 1 and 2.

A window fan 11 has a housing 12 including a front wall 13, a rear wall 14, a first side wall 15 joining opposite edges of the front and rear walls 13 and 14, a second side wall 16 joining opposite edges of the front and rear walls 13 and 14; a bottom wall 17 joining the front and rear walls 13 and 14 and the first and second side walls 15 and 16, and a top wall 18 also joining the front and rear walls 13 and 14 and the first and second side walls 15 and 16. Extending upwardly from opposite ends of the front wall 13 are a pair of tabs 21. Also projecting upwardly from opposite ends of the rear wall 14 are a pair of tabs 22. Defined by the front wall 13 is an air outlet 25 formed by a pair of rectangular openings 26 covered by grills 24 and separated by a divider wall portion 27. Each of the openings 26 is covered by a grill 27. Defined by the rear wall 14 is an air inlet 31 formed by a pair of circular openings 32 covered by grills 30 and separated by a divider wall portion 33.

The housing 12 is formed by a front housing portion 35 that defines the front wall 13 and portions of the first and second side walls 15, 16 and the bottom and top walls 17, 18; and a rear housing portion 36 defining the rear wall 14 and remaining portions of the first and second side walls 15, 16 and the bottom and top walls 17, 18. Extending inwardly from the front housing portion 35 are a plurality of hollow studs 38 that align with internally threaded posts 39 projecting inwardly from the rear housing portion 36. The studs 38 and posts 39 accommodate screws 41 that secure the front housing portion 35 to the rear housing portion 36. Also extending inwardly from the rear housing portion 36 are a pair of circular partitions 43 each aligned with one of the circular openings 32 in the rear wall 14. Retained by the rear wall portion 36 within each of the partitions 43 is an electrically energized blower fan 45. Connected to the fans 45 is a rotary switch 47 (FIG. 1) centrally located within the housing 12 and operatively coupled to a front operating lever arm 51 projecting through a slot 52 in the divider wall portion 27 of the front wall 13 and a rear lever arm 54 (FIG. 2) extending through a slot 55 in the divider wall portion 33 of the rear wall 14. A horizontally disposed arm 57 is mounted on the rear wall 14 in a position above the divider wall portion 33. The arm 57 is mounted for reciprocal movement between an outer position projecting outwardly from the rear wall 14 and an inner position recessed in a slot 58.

Figure 1:
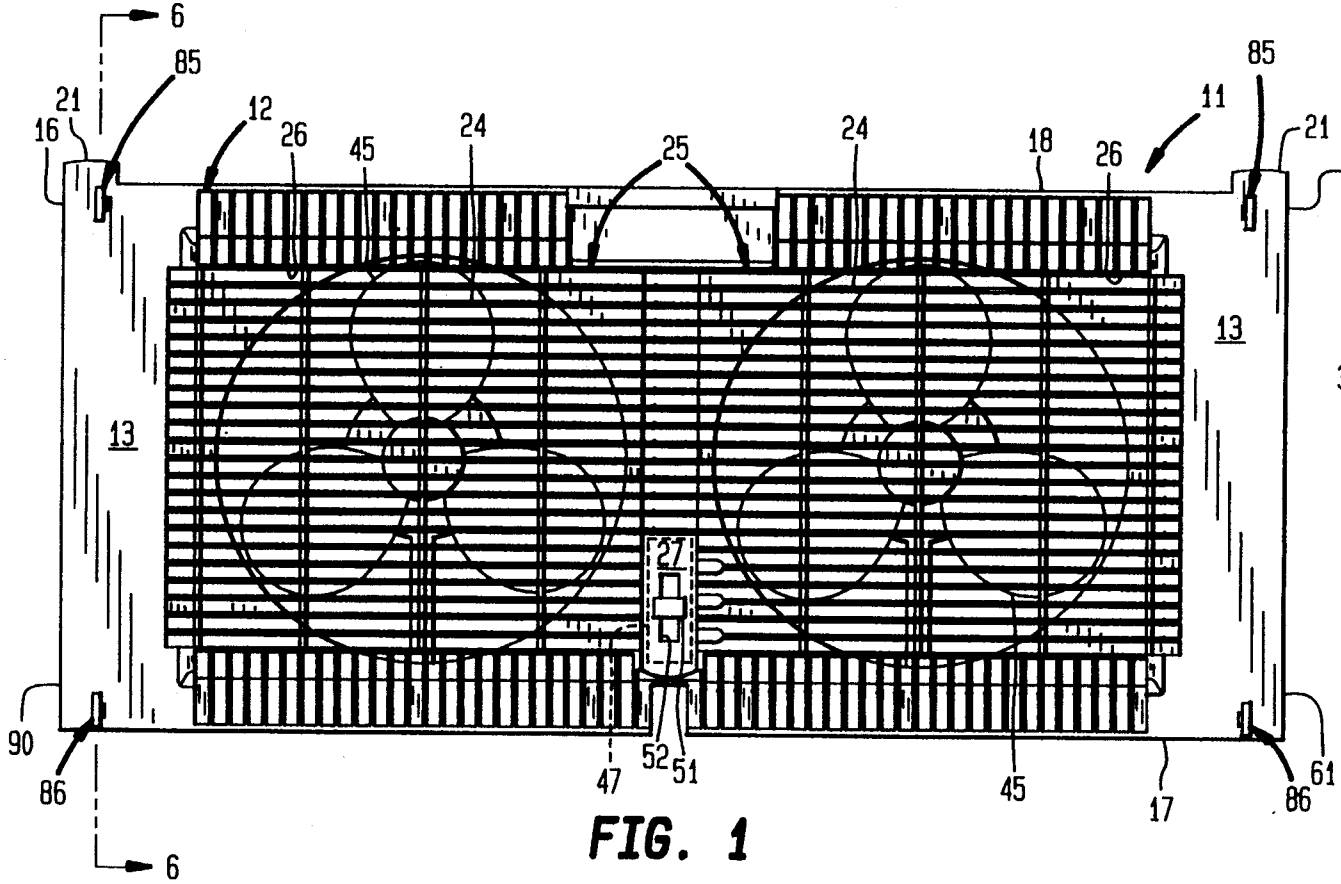
FIG. 1 is a front elevational view of a fan according to the invention.
Figure 2:
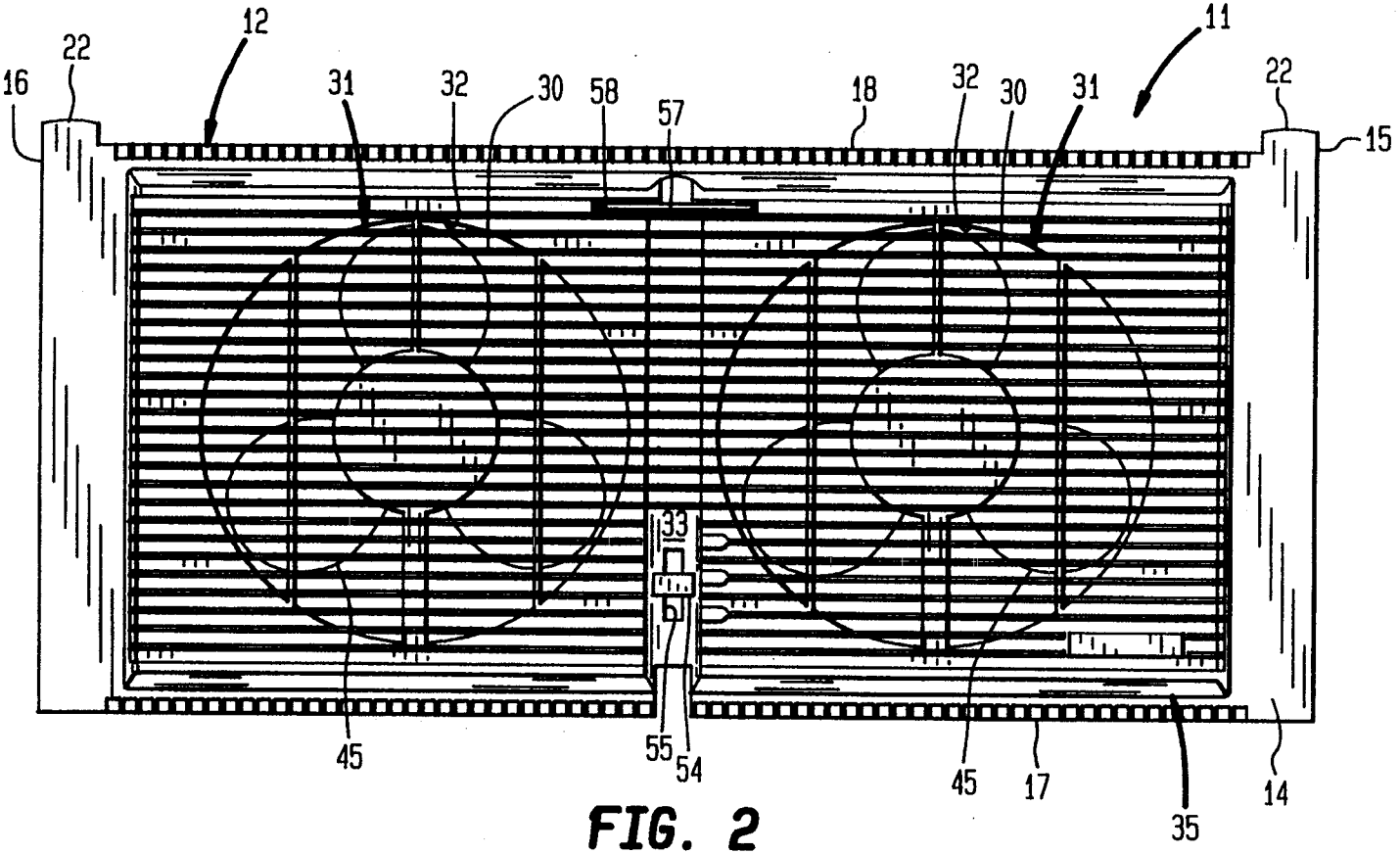
FIG. 2 is a rear elevational view of the fan shown in FIG. 1.
Figure 4:
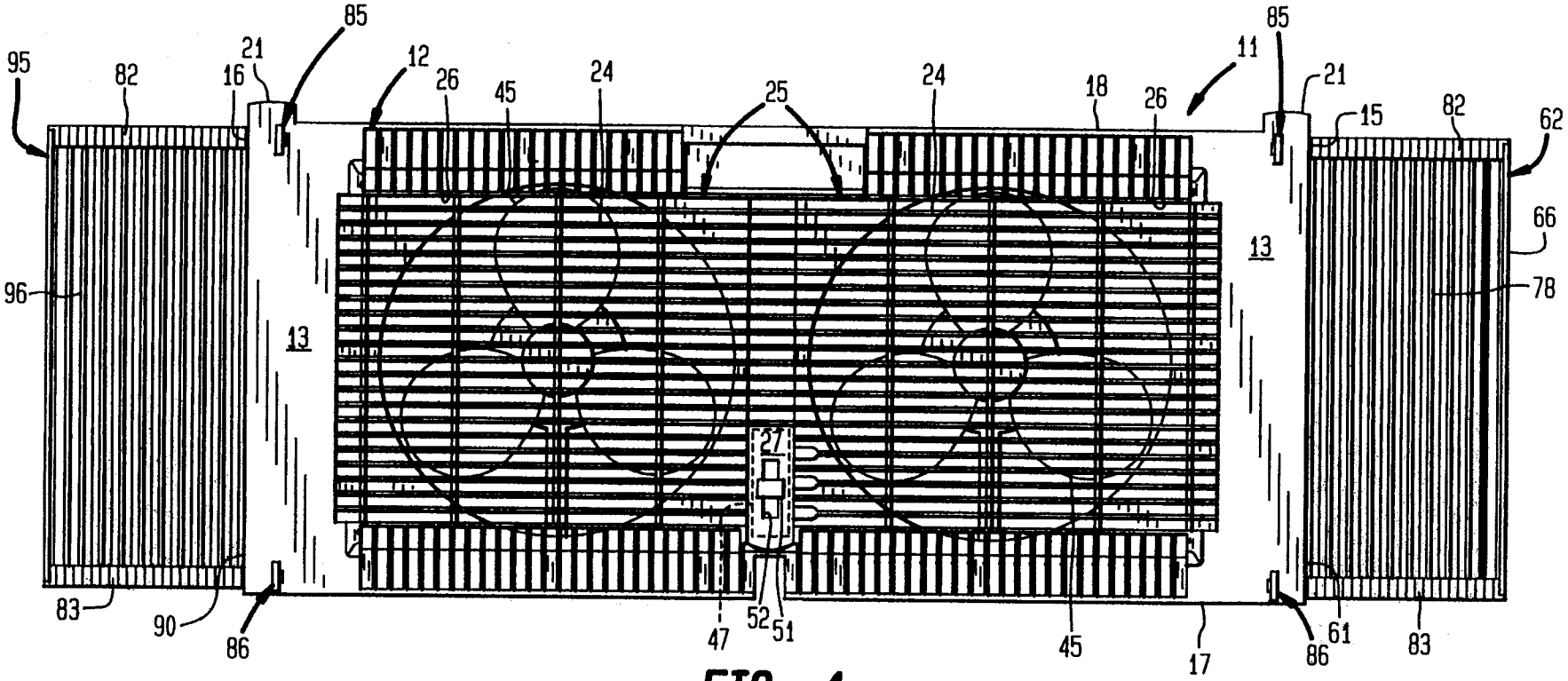
FIG. 4 is a front elevational view of the fan with transverse wing partitions projecting.
Figure 5:
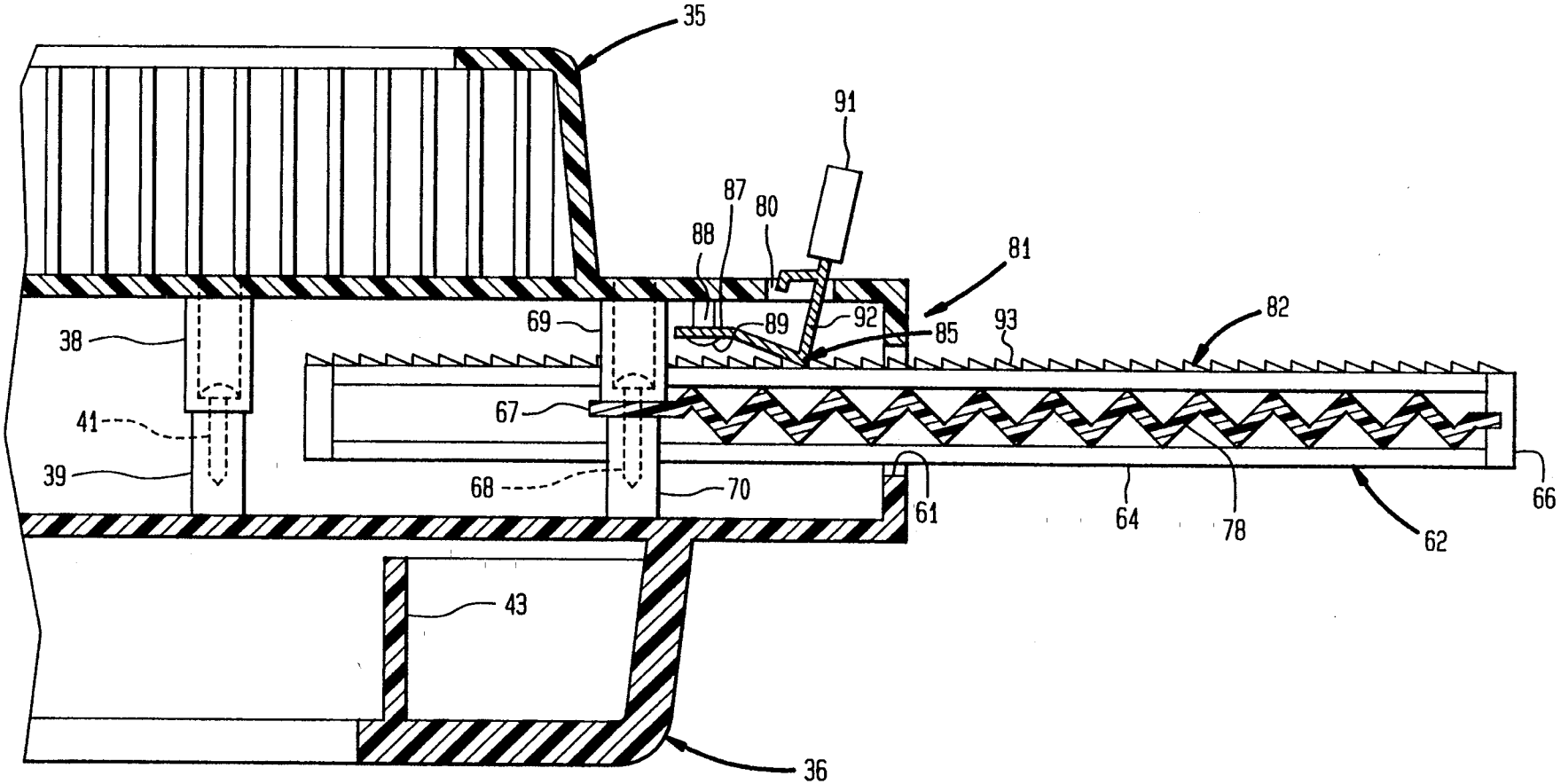
FIG. 5 is a partial cross-sectional view taken along lines 5—5 in FIG. 3.
Figure 6:
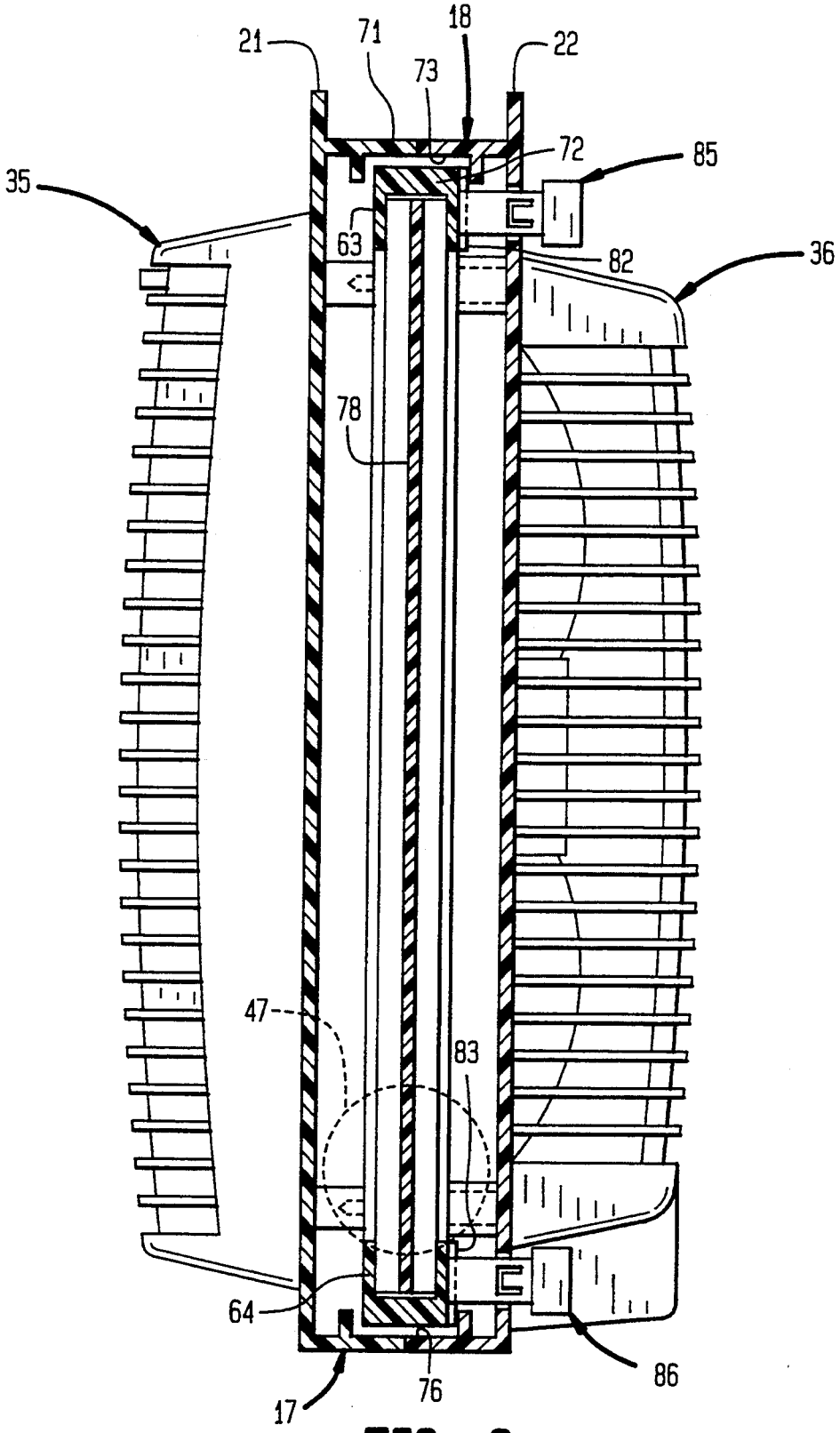
FIG. 6 is a partial cross sectional view taken along lines 6—6 in FIG. 1.

Formed in the first side wall 15 and extending vertically between opposite ends thereof is an elongated opening 61. Accommodated by the elongated opening 61 is a first partition 62 movable between a recessed position within the housing 12 as shown in FIGS. 1 and 2 and a projecting position outside the housing 12 as shown in FIGS. 4 and 5. The first partition 62 has an upper edge formed by a U-shaped member 63 and a lower edge formed by an identical U-shaped member 64 as shown in FIG. 6. A free outer edge of the first partition 62 is formed by an outer cross piece 66 (FIG. 5) fixed to outer ends of the U-shaped members 63, 64. Forming an inner edge of the first partition 62 is an inner cross piece 67 unattached to the U-shaped members 63, 64 but fixed by screws 68 to studs 69, 70 extending inwardly from the front and rear housing portions 35, 36.

A top wall portion of the rear housing portion 36 joins a top wall portion of the front housing portion 35 as shown in FIG. 6. Projecting inwardly from the top wall portions of the front and rear housing portions, respectively, are ribs 71, 72 that form a first channel 75 that slidably receives the U-shaped member 63. Similarly formed by the bottom wall 17 is a second channel 76 that slidably receives the lower U-shaped member 64.

Also included in the first partition 62 is a convoluted, flexible panel 78 having upper and lower edges received, respectively, by the upper U-shaped member 63 and lower U-shaped member 64 as shown in FIG. 6. An inner edge of the convoluted panel 78 is fixed to the inner cross piece 67 while an outer edge thereof is fixed to the outer cross piece 66. The panel 78 preferably is formed of a resilient plastic material and in a contracted condition as shown in FIGS. 1 and 2, but can be forcibly moved into an expanded condition as shown in FIGS. 4 and 5. However, in response to the removal of an expanding force on the panel 78 when in its expanded condition the inherent bias of the resilient panel causes some automatic contraction thereof.

A latch assembly 81 (FIGS. 5 and 6) includes one elongated ratchet bar 82 formed on one leg of the upper U-shaped member 64, one pawl 85 engageable with the one ratchet bar 82 and another pawl 86 engageable with the another ratchet bar 82. Each of the pawls 85, 86 is formed of spring material and includes an inner end 87 fixed to a stud 88 on the front wall housing portion 35 by a screw 89, an outer end 91 extending through an opening 80 in the rear wall 14 and an intermediate portion 92 that projects into tapered slots 93 formed in the ratchet bars 82, 83. When positioned within a tapered slot 93, the pawls 85, 86 function in a conventional manner to allow forcible movement of the ratchet bars 82, 83 in one direction but to prevent movement thereof in an opposite direction. However, upon withdrawal of the pawls 85, 86 out of the tapered slots 93, the ratchet bars 82, 83 are free to move in the opposite or inward direction.

Another elongated opening 90 (FIG. 3) is formed in the second side wall 16 and extends vertically between opposite ends thereof. Accommodated by the opening 90 and the second side wall 16 is movement of a second partition 95 between a recessed position within the housing 12 as shown in FIGS. 1 and 2 and a projecting position as shown in FIG. 4. The second partition 95 is identical to the first partition 62 and includes a second expandable panel 96 movable from a biased contracted condition into an expanded condition as described above in response to the application of an outwardly directed force and automatically movable toward the contracted condition upon disengagement of the pawls 85, 86 from the ratchet bars 82, 83.

OPERATION

Prior to use, the fan 11 is positioned with the bottom wall 17 of the housing 12 resting on a sill of an opened window (not shown). The window is then partially closed to position its bottom edge between the upwardly projecting tabs 21, 22. Next, the accessible free outer edge 66 of the recessed first partition 62 is grasped and pulled outwardly through the elongated opening 61 into engagement with a vertical side surface of the window opening. During this movement of the first partition 62, the U-shaped members 63, 64 slide freely within the channels 73, 76 as the pawls 85, 86 are cammed out of the tapererd slots 93 in the ratchet bars 82, 83 and the convoluted panel 78 expands from its contracted condition into its expanded condition shown in FIGS. 4 and 5. After reaching its desired projecting position, the first partition 62 is retained thereat by engagement of the intermediate portions 92 of the pawls 85 and 86 with vertical edges of aligned slots 93 in, respectively, the ratchet bars 82 and 83. Next, the second partition 95 is similarly moved into and then retained in a projecting position against an opposite vertical side of the window opening (not shown). When movement of the first and second partitions 62, 95 into their recessed positions within the housing 12 is desired, the pawls 85, 86 are pulled outwardly to eliminate engagement between their intermediate portions 92 and the ratchet bars 82, 83 thereby allowing the resilient panels 78, 96 to contract and move inwardly.

It will be noted, that the window fan 11 can be used in either an intake or exhaust mode. When used in an intake mode, the fan is positioned with the air outlet 25 in the front wall 13 facing inwardly. In that position, the lever arm 51 is accessible to activate the fans 45 and produce air movement into the air inlet 31 and out of the air outlet 25. Conversely, when operation in the exhaust mode is desired, the fan is positioned with the rear wall 14 facing inwardly in an open window. In that position, the lever arm 54 in the rear wall 14 is accessible to activate the fans 45 and produce air flow from within an enclosure into the air inlet 31 for exhaust out of the air outlet 25.

Obviously, many modifications and variations of the present invention are possible in light of the above teachings. It is to be understood, therefore, that the invention can be practiced otherwise than as specifically described.

What is claimed is:

1. A window fan comprising:

a housing comprising a bottom wall for mounting on a sill of a window opening, a front wall defining an air outlet, a rear wall defining an air inlet, a first side wall joined to said front wall and said rear wall, a second side wall joined to said front wall and said rear wall; and wherein said first side wall defines an elongated opening extending between opposite ends thereof;

a blower means retained by said housing and activatable to produce air flow between said air inlet and said air outlet;

partition means movable through said elongated opening into a projecting position extending between said first end wall and one side of the window opening, said partition means comprising a convoluted panel contractible into a recessed position within said housing and expandable into said projecting position, and wherein said convoluted panel is formed in a contracted condition from a resilient material that tends to return to said contracted condition after being expanded into an expanded condition thereby inherently biasing said partition means toward said recessed position; and latch means for retaining said partition means in said projecting position, said latch means comprising at least one ratchet bar movable with said partition means, and at least one pawl fixed to said housing and engaged with said ratchet bar.

2. A window fan according to claim 1 wherein said partition means further comprises an inner edge fixed within said housing and a free outer edge accessible through said elongated opening with said partition means in said recessed position.

3. A window fan according to claim 1 wherein said partition means has an upper edge and a lower edge, said one ratchet bar is substantially aligned with said upper edge, and said latch means further comprises another ratchet bar substantially aligned with said lower edge and another pawl fixed to said housing and engaged with said another ratchet bar.

4. A window fan according to claim 3 wherein said one ratchet bar has a free inner end and an outer end fixed to one end of said outer edge, and said another ratchet bar has a free inner end and an outer end fixed to an opposite end of said outer edge.

5. A window fan according to claim 4 wherein said housing defines a first channel slidably retaining said one ratchet bar, and a second channel slidably retaining said another ratchet bar.

6. A window fan according to claim 1 wherein said second side wall defines another opening extending between opposite ends thereof, and said partition means comprises a first partition biased into a recessed position within said housing and movable through said elongated opening into a projecting position extending between said first end wall and one side of the window opening and a second partition biased into a recessed position within said housing and movable through said another opening into a projecting position extending between said second end wall and an opposite side of the window opening.

7. A window fan according to claim 6 wherein each of said first and second partitions comprises a convoluted panel contractible into said recessed position within said housing and expandable into said projecting position.

8. A window fan according to claim 7 wherein each said convoluted panel is formed in a contracted condition from a resilient material that tends to return to said contracted condition after being expanded into an expanded condition thereby inherently biasing each of said first and second partitions toward said recessed positions.

9. A window fan according to claim 8 wherein said first partition comprises an inner edge fixed within said housing and a free outer edge accessible through said elongated opening with said first partition in said recessed position, and said second partition comprises an inner edge fixed within said housing and a free outer edge accessible through said another opening with said second partition in said recessed position.

10. A window fan according to claim 9 wherein said latch means further comprises a second ratchet bar movable with said second partition, and another pawl fixed to said housing and engaged with said second ratchet bar.

11. A window fan according to claim 10 wherein each of said first and second partitions has an upper edge and a lower edge, said one ratchet bar is substantially aligned with said upper edge, and said latch means further comprises another ratchet bar substantially aligned with said lower edge of each of said first and second partitions and another pawl fixed to said housing and engaged with each said another ratchet bar.

12. A window fan according to claim 11 wherein each said one ratchet bar has a free inner end and an outer end fixed to one end of one of said outer edges, and each said another ratchet bar has a free inner end and an outer end fixed to an opposite end of one of said outer edges.

13. A window fan according to claim 12 wherein said housing defines a plurality of channels each slidably retaining a different one of said ratchet bars.

* * * * *